US009517173B1

(12) United States Patent
Langmacher

(10) Patent No.: US 9,517,173 B1
(45) Date of Patent: Dec. 13, 2016

(54) STRETCHING BELT FOR STRETCHING OF THE SPINE

(71) Applicant: Tom Langmacher, Washougal, WA (US)

(72) Inventor: Tom Langmacher, Washougal, WA (US)

( * ) Notice: Subject to any disclaimer, the term of this patent is extended or adjusted under 35 U.S.C. 154(b) by 0 days.

(21) Appl. No.: 14/792,488

(22) Filed: Jul. 6, 2015

(51) Int. Cl.

| | |
|---|---|
| ***A63B 26/00*** | (2006.01) |
| ***A61H 1/02*** | (2006.01) |
| ***A63B 23/02*** | (2006.01) |
| *A63B 23/00* | (2006.01) |

(52) U.S. Cl.
CPC ..... *A61H 1/0218* (2013.01); *A63B 21/4007* (2015.10); *A63B 21/4039* (2015.10); *A63B 23/0238* (2013.01); *A63B 2023/006* (2013.01)

(58) Field of Classification Search
CPC ..... A63B 21/0004; A63B 21/00178; A63B 21/00185; A63B 21/002; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/16; A63B 21/1609; A63B 21/1618; A63B 21/1627; A63B 21/1636; A63B 21/1645; A63B 21/1654; A63B 21/1663; A63B 21/1681; A63B 21/169; A63B 21/4007; A63B 21/4009; A63B 21/4023; A63B 21/4025; A63B 21/4039; A63B 21/4043; A63B 2023/006; A63B 23/02; A63B 23/0216; A63B 23/0233; A63B 23/0238; A63B 69/0057; A63B 69/0059; A63B 69/0064; A63B 2208/0285; A63B 2208/029; A63B 2209/10; A63B 2209/14
USPC ..... 482/907, 69
See application file for complete search history.

(56) References Cited

U.S. PATENT DOCUMENTS

| | | | | | |
|---|---|---|---|---|---|
| 1,116,773 | A | * | 11/1914 | West et al. | A61H 1/0218 602/36 |
| 1,556,496 | A | * | 10/1925 | Davis | A63B 21/068 482/96 |
| 2,821,978 | A | * | 2/1958 | Lindstrom | A61H 1/0218 602/33 |
| 3,167,068 | A | * | 1/1965 | Carr | A61H 1/0218 602/32 |
| 3,759,255 | A | * | 9/1973 | Taylor | A61H 1/0218 602/32 |
| 4,125,257 | A | * | 11/1978 | Lew | A63B 7/00 24/129 B |
| 4,146,021 | A | * | 3/1979 | Brosseau | A61H 1/0218 602/36 |
| 4,396,012 | A | * | 8/1983 | Cobiski | A61H 1/0218 602/36 |

(Continued)

*Primary Examiner* — Stephen Crow
*Assistant Examiner* — Gary D Urbiel Goldner
(74) *Attorney, Agent, or Firm* — Plager Schack LLP

(57) ABSTRACT

Some embodiments of the present disclosure include a stretching device for stretching and aligning a user's back. The stretching device may include a belt configured to wrap around the user's back and under the user's armpits and a first ring attached to a first end of the belt and a second ring attached to a second end of the belt, wherein the first ring and the second ring may engage with a hook such that the device may hang from a support system, using gravity to stretch and align the user's back.

14 Claims, 3 Drawing Sheets

(56) References Cited

U.S. PATENT DOCUMENTS 4,534,341 A * 8/1985 Bart ..... A61H 1/0218 482/143
4,603,689 A * 8/1986 Horner ..... A61H 1/0218 602/32
4,826,155 A * 5/1989 James ..... A63B 21/00181 482/104
4,964,401 A * 10/1990 Taigen ..... A61F 5/028 128/876
4,991,572 A * 2/1991 Chases ..... A61H 1/0218 128/DIG. 20
5,046,488 A * 9/1991 Schiek, Sr. ..... A61F 5/028 2/338
5,094,228 A * 3/1992 Reinert ..... A61H 1/008 606/243
5,242,380 A * 9/1993 Steinbrueck ..... A61H 1/0218 482/43
5,388,274 A * 2/1995 Glover ..... A61F 5/028 128/100.1
5,403,253 A * 4/1995 Gaylord ..... A63B 21/068 482/140
5,403,270 A * 4/1995 Schipper ..... A61H 1/0229 602/36
5,772,622 A * 6/1998 Friske ..... A61H 1/0218 428/99
5,839,999 A * 11/1998 Pflugner ..... A63B 21/023 482/125
6,517,506 B1 * 2/2003 Pettibon ..... A61F 5/04 602/32
6,733,470 B1 * 5/2004 DeGeorge ..... A61H 1/008 602/32
7,063,678 B1 * 6/2006 Cook ..... A61F 5/02 602/40
7,255,666 B2 * 8/2007 Cardenas ..... A61H 1/0229 482/143
7,814,866 B1 * 10/2010 Gramza ..... A01K 27/00 119/770
8,657,770 B1 * 2/2014 Clark, Jr. ..... A61F 5/028 602/19
9,308,113 B2 * 4/2016 Tillotson ..... A61F 5/048
2005/0009669 A1 * 1/2005 Harris ..... A63B 21/4009 482/69
2006/0178607 A1 * 8/2006 Evans ..... A61F 5/3776 602/33
2006/0189908 A1 * 8/2006 Kennedy ..... A61F 5/3769 602/36
2006/0199711 A1 * 9/2006 Miers ..... A63B 21/0552 482/124
2007/0161473 A1 * 7/2007 McBride ..... A63B 21/065 482/105
2007/0287609 A1 * 12/2007 McBride ..... A63B 21/4009 482/105
2009/0062087 A1 * 3/2009 Poppinga ..... A63B 21/0552 482/124
2009/0306568 A1 * 12/2009 Meyer ..... A61H 1/0218 602/33
2010/0167882 A1 * 7/2010 Colk ..... A63B 7/00 482/71
2011/0237399 A1 * 9/2011 Toback ..... A63B 5/16 482/8
2011/0319235 A1 * 12/2011 Garrett ..... A63B 21/00065 482/105
2014/0024508 A1 * 1/2014 Hinds ..... A63B 21/02 482/129
2014/0155229 A1 * 6/2014 Nikkaran ..... A63B 21/068 482/99
2014/0200499 A1 * 7/2014 Champion ..... A63B 21/151 602/36
2014/0214044 A1 * 7/2014 Robinson ..... A61B 17/885 606/90
2014/0274593 A1 * 9/2014 Kelly ..... A63B 21/0004 482/105
2015/0297937 A1 * 10/2015 Burkinshaw ..... A63B 21/1403 482/124
2015/0343253 A1 * 12/2015 Nikkaran ..... A63B 21/068 482/96
2016/0023051 A1 * 1/2016 Lauener ..... A61H 1/0229 482/143

* cited by examiner

STRETCHING BELT FOR STRETCHING OF THE SPINE

BACKGROUND

The embodiments herein relate generally to pain relief and stretching, and more particularly, to a stretching belt for stretching the spine to relieve back pain.

Back pain and stiffness may be caused by compression of the spine. Proper alignment of the spine is known to reduce back pain. Conventional methods for aligning the spine include going to a chiropractor or trying to sufficiently stretch the spine. However, adequate stretching of the spine is not easily achieved. A compression belt may be used to alleviate back pain; however, compression belts fail to stretch and align the spine. Moreover, compression belts only provide some relief to back pain when worn; they do not alleviate any back pain when not being physically worn by the user. Therefore, a conventional compression belt is only a temporary solution to lower back pain.

Therefore, what is needed is a device for stretching the spine, resulting in immediate or almost immediate and lasting back pain relief by, for example, aligning the vertebrae in the spine.

SUMMARY

Some embodiments of the present disclosure include a stretching device for stretching and aligning a user's back. The stretching device may include a belt configured to wrap around the user's back and under the user's armpits and a first ring attached to a first end of the belt and a second ring attached to a second end of the belt, wherein the first ring and the second ring may engage with a hook such that the device may hang from a support system, using gravity to stretch and align the user's back.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
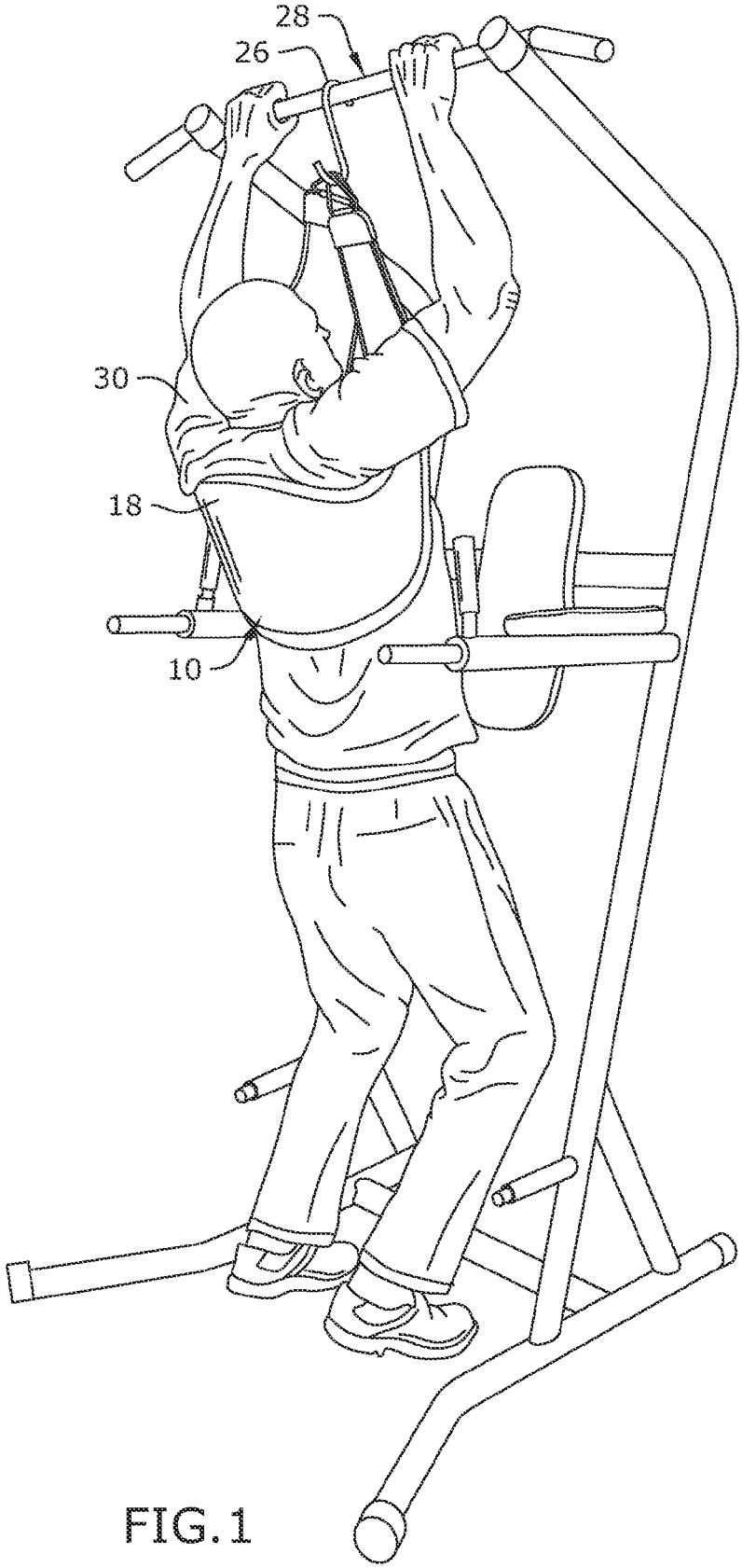
FIG. 1 is a perspective view of one embodiment of the present disclosure shown in use.
Figure 2:
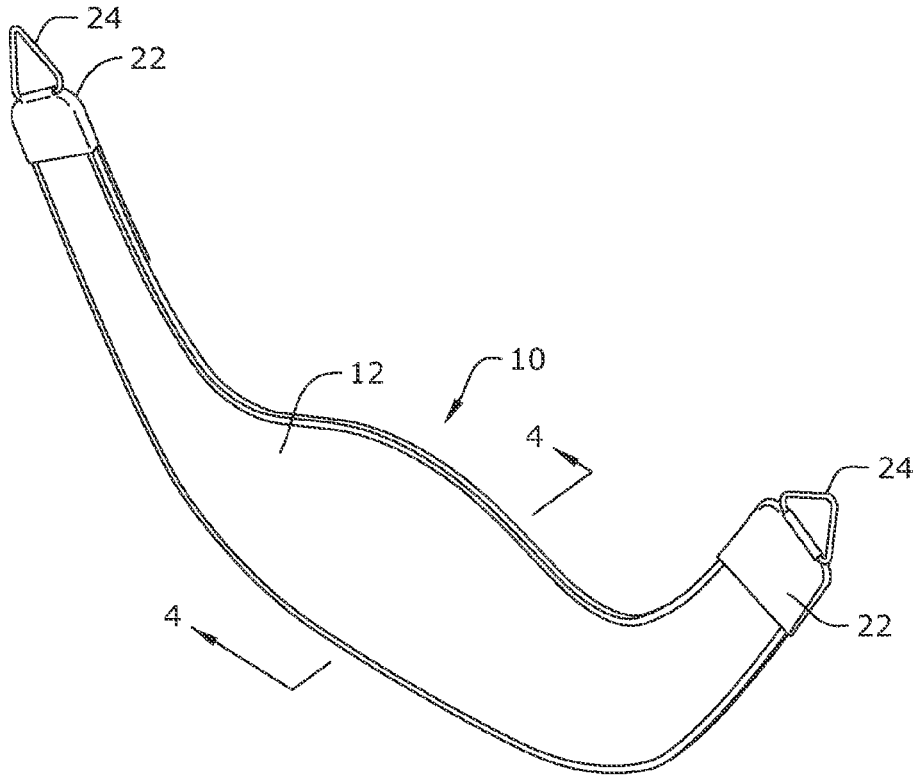
FIG. 2 is a perspective view of one embodiment of the present disclosure.
Figure 3:
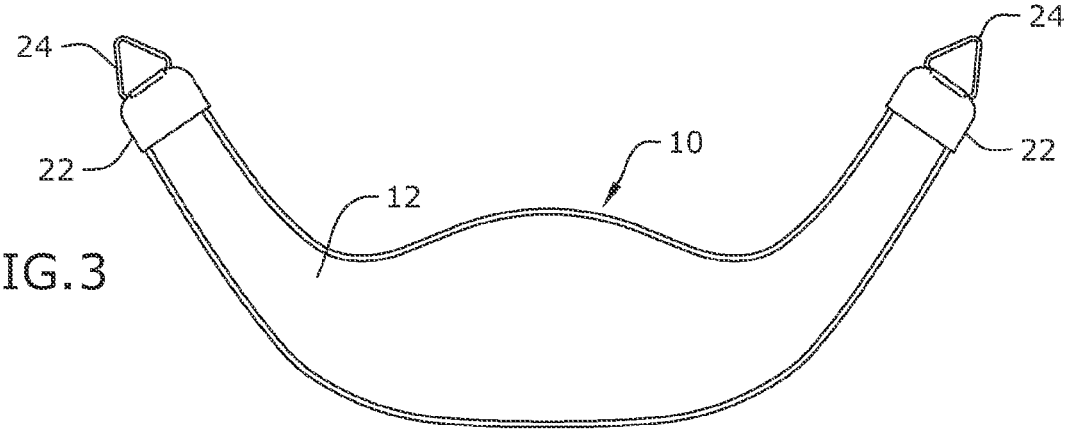
FIG. 3 is a front view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to stretch and align a user's spine using gravity and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Belt
2. Layered Construction
3. Rings

The various elements of the stretching device for stretching and aligning a user's spine of the present disclosure may be related in the following exemplary fashion. It is not intended to limit the scope or nature of the relationships between the various elements and the following examples are presented as illustrative examples only.

By way of example, and referring to FIGS. 1-6, some embodiments of the device of the present disclosure comprise a belt 10 configured to partially encircle a user's torso, such that the belt 10 wraps around a user's back and under the user's armpits, the belt 10 comprising two ends, wherein each end comprises a ring 24 configured to engage with, for example, a hook 26, such as an S-hook, such that the user 30 may place the belt 10 around his or her torso and allow the belt 10 to hold the individual above the ground, thus using gravity to stretch and align the spine. The belt 10 may create a gripping action due to the structure of the belt 10, wherein the gripping action may be increased or decreased depending on the amount of weight placed on the belt 10, creating more or less tightening around the body and stretching of the spine.

As shown in the Figures, the belt 10 may have a rounded W shape, wherein the central portion of the device may be configured to align with a central portion of a user's back. For example, as shown in the Figures, the belt 10 may be configured to wrap around a thoracic area of the user's back, wherein, as a result of gravity pulling the user down, the belt 10 may pull upwards on a user's thoracic spine. From the central portion, the device may curve downward, creating an allowance and comfortable fit for a user's armpits when the device is in use, such that the belt 10 may avoid direct contact with a user's armpits in favor of an overall gripping of the torso. Each end of the belt 10 may comprise a ring 24, such as triangular shaped ring. The ring 24 may be attached to the belt 10 using any known fastener or fastening method and, in some embodiments, each ring 24 may be double-stitched into the ends of the belt by folding excess material through the ring 24. Each ring 24 may be further secured to the belt using a sleeve 22, which may be pulled over the rings 24, wherein the rings 24 extend through an orifice in the sleeve 22. In some embodiments, each sleeve 24 may comprise an elastic material and may be adhered or otherwise attached to the belt 10.

Figure 4:
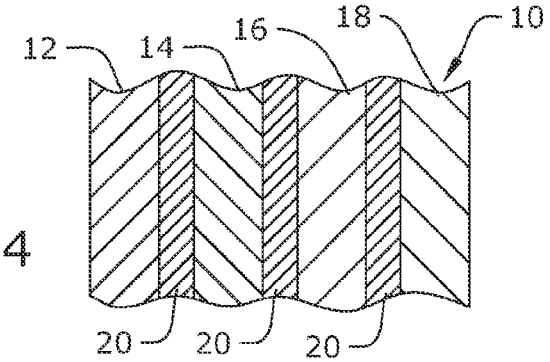
FIG. 4 is a section view of one embodiment of the present disclosure, taken along line 4-4 in FIG. 2.
Figure 5:
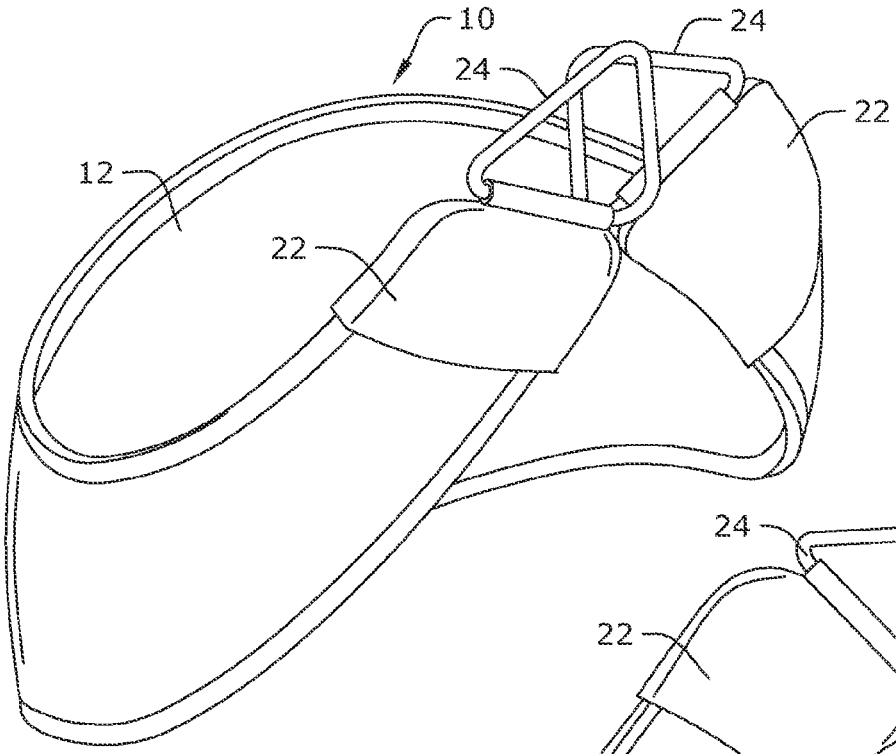
FIG. 5 is a front perspective view of one embodiment of the present disclosure.
Figure 6:
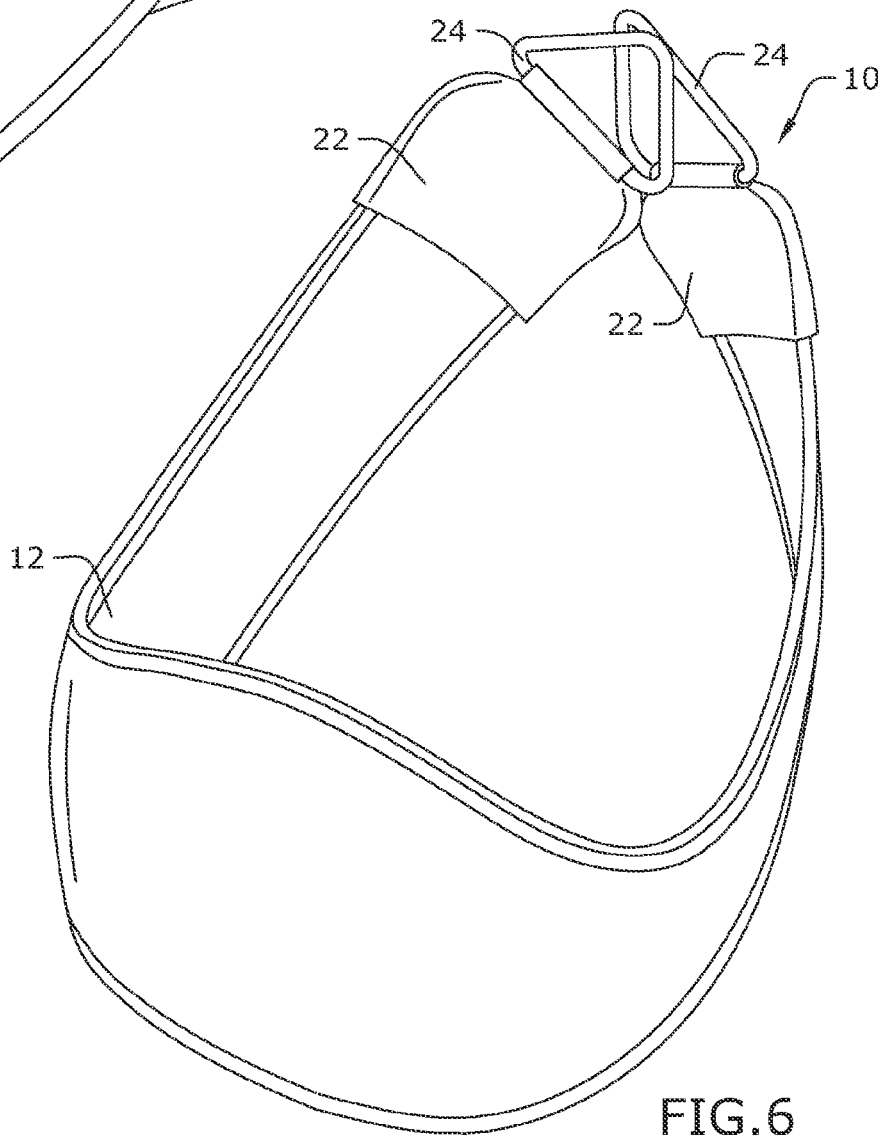
FIG. 6 is a front perspective view of one embodiment of the present disclosure.

As shown in FIG. 4, the belt 10 may have a layered construction, which may result in the belt 10 acting like a cinch that grips the user proportionally to the gravity tension. For example, the belt 10 may comprise, in order, an inner grip material layer 12, a foam material 14, a webbing material 16, and an outer material 18, wherein the inner layer 12 may be positioned against a user's body. The layers may be attached using any known fastener and, in some embodiments, are adhered together using a layer of contact glue 20 positioned between each adjacent layer. The layers may be made of any suitable or desired materials. In some embodiments, the inner grip material layer 12 may comprise a neoprene grip material configured to grip onto the user to prevent the belt 10 from slipping along the user's back when gravity tension is applied. The foam material layer 14 may comprise a neoprene foam material and may provide extra comfort to the user 30. The webbing material layer 16 may comprise a polyester webbing material and may provide the belt 10 with strength. Finally, the outer material layer 18 may comprise a decorative material, such as leather or vinyl, and may function as an outer layer to provide durability and a finished looking product.

For clarification purposes, the belt 10 may function in a manner similar to a Chinese finger trap, wherein tightening is caused by pulling on the device. Specifically, the webbing material layer 16 may have warp and weft threads, wherein when the webbing material layer 16 is pulled on due to gravity pulling the user's body downward, the angle between the warp and weft threads and their crossing points may be reduced. The more gravity tension applied to the belt, the more the webbing material layer 16 may tighten.

The stretching device of the present disclosure may be used as follows. A user 30 may wrap the belt 10 around the user's back and under the armpits. While in a standing position, the rings 24 may be attached to a hook 26, such as that shown in FIG. 1, wherein the hook 26 is attached to a support system, such as a chin up bar 28. The user 30 may then bend at the knees, allowing the belt 10 to hold the user 30 from the ground. The gravity from the individual's lower body may stretch the spine and connected tendons and muscles. The stretching action may promote the vertebrae to naturally stretch along the spine. Thus, the stretching device may provide sufficient strength, stiffness, stretch, and comfort to promote relaxation, which may be key to promoting vertebrae alignment while stretching. Stretching and alignment may be achieved immediately or almost immediately, such as within about 30 seconds to within about a minute.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A stretching device for stretching and aligning a user's back, the stretching device comprising:

a belt configured to wrap around the user's back and under the user's armpits, the belt comprising a first end, a central portion, and a second end; and a first ring attached to the first end of the belt and a second ring attached to the second end of the belt, wherein:

the first ring and the second ring are configured to engage with a hook; and the hook is configured to engage with a support system such that the user is suspended by the belt, using gravity to stretch and align the spine;

the belt, when laid flat, has a planar rounded W-shape such that the first end and the second end curve upwards from the central portion; and when the stretching device is in use, the belt curves downward from the central portion creating an allowance and comfortable fit for the user's armpits.

2. The stretching device of claim 1, wherein the belt has a layered construction.

3. The stretching device of claim 2, wherein the layered construction comprises, in order:

an inner gripping material layer, wherein the inner gripping material layer is defined as a layer that is positioned adjacent to the user's body;

a foam material layer;

a webbing material layer; and an outer layer.

4. The stretching device of claim 3, wherein an adhesive layer is positioned between each adjacent layer to hold the layered construction together.

5. The stretching device of claim 3, wherein:

the inner gripping material layer comprises a neoprene gripping material;

the foam material layer comprises a neoprene foam material; and the webbing material layer comprises a polyester webbing material.

6. The stretching device of claim 1, further comprising:

a first sleeve positioned over the first ring, wherein the first ring extends through an orifice in the first sleeve; and a second sleeve positioned over the second ring, wherein the second ring extends through an orifice in the second sleeve.

7. The stretching device of claim 1, wherein, when in use, the shape of the belt is configured to hold the user and maintain a natural curvature of the user's spine.

8. The stretching device of claim 1, wherein:

the belt, when laid flat, has a top edge and a bottom edge;

the bottom edge comprises a smooth curve; and the top edge comprises a curve with a bump in the central portion, defining the allowance for each of the user's armpits.

9. A stretching device for stretching and aligning a user's back, the stretching device comprising:

a layered belt configured to wrap around the user's back and under the user's armpits, the layered belt comprising a first end, a central portion, and a second end;

a first ring attached to the first end of the layered belt and a second ring attached to the second end of the layered belt; and an S-hook configured to engage with the first ring and the second ring, wherein:

the S-hook is configured to engage with a bar such that the user is suspended by the layered belt, using gravity to stretch and align the user's spine;

the layered belt, when laid flat, has a planar rounded W-shape; and when the stretching device is in use, the layered belt curves downward from the central portion creating an allowance and comfortable fit for the user's armpits.

10. The stretching device of claim 9, wherein the layered belt comprises, in order:

an inner neoprene gripping material layer, wherein the inner neoprene gripping material layer is defined as a layer being positioned against the user's body;

a neoprene foam material layer; and a polyester webbing material layer.

11. The stretching device of claim 9, wherein the central portion of the layered belt is configured to align with a central portion of the user's back.

12. The stretching device of claim 9, wherein the layered belt is configured to wrap around a thoracic portion of the user's back.

13. The stretching device of claim 9, wherein, when in use, the shape of the layered belt is configured to hold the user and maintain a natural curvature of the user's spine.

14. The stretching device of claim 9, wherein:

the layered belt, when laid flat, has a top edge and a bottom edge;

the bottom edge comprises a smooth curve; and the top edge comprises a curve with a bump in the central portion, defining the allowance for each of the user's armpits.

* * * * *